US010563427B2

(12) United States Patent
Sims et al.

(10) Patent No.: US 10,563,427 B2
(45) Date of Patent: Feb. 18, 2020

(54) INTEGRATED ADJUSTABLE KEEPER SHIM FOR AN ELECTRIC STRIKE

(71) Applicant: Hanchett Entry Systems, Inc., Phoenix, AZ (US)

(72) Inventors: Ryan Matthew Sims, Mesa, AZ (US); Michael Allen Webb, Cave Creek, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 737 days.

(21) Appl. No.: 15/098,565

(22) Filed: Apr. 14, 2016

(65) Prior Publication Data

US 2016/0305158 A1 Oct. 20, 2016

Related U.S. Application Data

(60) Provisional application No. 62/147,468, filed on Apr. 14, 2015.

(51) Int. Cl.
*E05B 47/00* (2006.01)
*E05B 15/02* (2006.01)

(52) U.S. Cl.
CPC ..... *E05B 47/0047* (2013.01); *E05B 15/025* (2013.01); *E05B 47/0002* (2013.01); *E05B 47/0012* (2013.01); *Y10T 292/699* (2015.04)

(58) Field of Classification Search
CPC ..... Y10T 292/68; Y10T 292/696; Y10T 292/699; Y10T 292/702; E05B 15/025; E05B 47/0047
See application file for complete search history.

(56) References Cited

U.S. PATENT DOCUMENTS 1,245,617 A * 11/1917 Prinzler ..... E05B 15/0245 292/341.18
4,113,293 A * 9/1978 Paquette ..... E05B 15/025 292/341.18
4,130,260 A * 12/1978 Poe ..... B64C 1/14 244/129.5

(Continued)

FOREIGN PATENT DOCUMENTS

DE 2056351 A1 * 6/1972 ..... E05B 47/0047
EP 0841447 A1 * 5/1998 ..... E05B 15/0245

(Continued)

*Primary Examiner* — Carlos Lugo
(74) *Attorney, Agent, or Firm* — Woods Oviatt Gilman LLP; Ronald J. Kisicki, Esq.

(57) ABSTRACT

An integrated adjustable keeper shim for an electric strike is provided. The keeper shim may be included in a keeper assembly of the electric strike, wherein the electric strike includes a housing defining an entry chamber that operates in conjunction with a latch of a lockset. The engaged position of the latch secures a door within the entry chamber when the door is in a closed state. The keeper assembly comprises a keeper rotatably mounted to the housing, and is movable between a locked position and an unlocked position. The keeper retains the latch in the entry chamber when the keeper is in the locked position and the latch is in the engaged position. The keeper shim is adjustably mounted to the keeper, wherein a position of the keeper shim relative to the keeper is selected to minimize a gap defined between the keeper shim and the latch.

24 Claims, 8 Drawing Sheets

(56) References Cited

U.S. PATENT DOCUMENTS

| | | | | | |
|---|---|---|---|---|---|
| 4,216,986 | A * | 8/1980 | McNinch | E05C 17/50 | 16/82 |
| 4,288,120 | A * | 9/1981 | Moore | E05B 15/025 | 292/341.18 |
| 4,957,316 | A * | 9/1990 | Frolov | E05C 19/166 | 292/251.5 |
| 5,511,839 | A * | 4/1996 | Fuss | E05B 47/0047 | 292/341.12 |
| 6,082,791 | A * | 7/2000 | Frolov | E05B 47/0047 | 292/201 |
| 6,260,892 | B1 * | 7/2001 | Chang | E05C 19/166 | 292/251.5 |
| 6,886,305 | B2 * | 5/2005 | Ward | E05B 47/0047 | 292/341.16 |
| 8,544,895 | B2 * | 10/2013 | Webb | E05B 47/0047 | 292/201 |
| 2007/0182168 | A1 * | 8/2007 | Allen | E05B 15/024 | 292/340 |
| 2011/0181060 | A1 * | 7/2011 | Geringer | E05B 47/0047 | 292/341.16 |
| 2013/0088023 | A1 * | 4/2013 | Singh | E05B 47/0047 | 292/341.16 |

FOREIGN PATENT DOCUMENTS

| | | | | |
|---|---|---|---|---|
| EP | 2543796 | A2 * | 1/2013 | E05B 47/0047 |
| FR | 2400100 | A1 * | 3/1979 | E05B 15/025 |
| FR | 2560918 | A1 * | 9/1985 | E05B 47/0047 |
| FR | 2978977 | A3 * | 2/2013 | E05B 47/0047 |

* cited by examiner

INTEGRATED ADJUSTABLE KEEPER SHIM FOR AN ELECTRIC STRIKE

CROSS-REFERENCE TO RELATED APPLICATIONS

This application claims the benefit of U.S. Patent Application No. 62/147,468, filed Apr. 14, 2015, the contents of which are hereby incorporated by reference in its entirety.

TECHNICAL FIELD

The present invention is directed to an integrated adjustable keeper shim; more particularly, an integrated adjustable keeper shim included in a keeper assembly of an electric strike used to selectively secure a door including a lockset to a door frame, wherein the keeper shim is configured to allow for the offloading of a preload pressure on the locket caused by a preloaded door condition, reduce a gap between a keeper and the lockset to minimize excess movement or rattle in the door, ensure that a dead latch of the lockset does not extend to a fully extended position behind the keeper to render the door unsecure, and allow the gap to be easily adjustable based on the condition of the door for the life of the electric strike.

BACKGROUND OF THE INVENTION

As is known in the art of door latching, with reference to FIGS. 1 and 2, typically an electrically-controlled strike 10 is mounted in a door frame 12 and is configured to engage a lockset 14 disposed on or in an edge portion of a door. The lockset may be a mortise-type lockset or a cylindrical-type lockset (a mortise-type lockset is shown). Typically, lockset 14 includes a spring latch 16, and possibly a dead latch 18. In either lockset type, spring latch 16 is reciprocally moveable between an engaged position (extended) so that it can be positioned in a strike cavity 20 defined in a housing 22 of strike 10 to secure the door in a closed state, and a released position, wherein spring latch 16 is permitted to exit strike cavity 20 and to release the door from the closed state and is free to open. Similarly, dead latch 18, which in a cylindrical lockset-type is adjacent the spring latch, is reciprocally moveable between an enabling position (extended) that permits movement of spring latch 16 from its engaged position to the released position and a disabling position (depressed) that prohibits movement of spring latch 16 from its engaged position to its release position. Typically, spring 16 latch is resiliently biased into the engaged position and dead latch 18 is resiliently biased into the enabled position. Strike 10 also may include a keeper 24 rotatably disposed in housing 22 between a locked position to retain spring latch 16 in strike cavity 20 when in the engaged position, and an unlocked position allow for the release of the spring latch from strike 10 and the opening of the door. In a cylindrical-type locket, keeper 24 may operate to retain the dead latch in disabling position when in the locked position.

Whether used in conjunction with a cylindrical-type locket or a mortise-type lockset, when the door is closed and the latch is secured behind the keeper of the strike, a minimal gap between the extended latch and the locked keeper is desirable. If the gap is too large, the door will rattle within the strike cavity when the latch is in the extended position. A gap that is too large can also have a negative effect on the operation and performance of the dead latch in a cylindrical-type locket. In a cylindrical-type locket, the dead latch may be held in its disabling position by the keeper when the keeper is in its locked position. A gap that is too large between the keeper and the spring latch may allow the dead latch to move to the enabling position (extended) behind the keeper thereby allowing the spring latch to be freely moved to the released position and the door to be opened eliminating the functionality and security provided by the dead latch. If a negative gap is present in a preloaded door condition, the spring latch cannot move to the extended position behind the keeper when the door is closed, which prevents the lockset from securing the door in the frame.

Various factors may affect the size of the gap between the spring latch and the keeper after the locket and strike are installed. Initially, a dimensional stack-up between the door and the frame may affect the resulting size of the gap. To address the gap upon installation of the strike, a collection of separate shims having varying thicknesses are typically provided with the strike. Depending upon the resulting gap, a suitable thickness shim is selected, and then fixedly and non-adjustably secured to the inside surface of the keeper. While the use of a shim may be adequate at the time the strike is installed, a large cause of the resulting gap that presents itself over time is due to the door sagging in the door frame and through use of the door over time. As the door components (hinges, keeper surface, etc.) wear, the gap between the keeper and the spring latch increases. It is not uncommon for the extra shims that are provided with the strike to be discarded after initial assembly or lost when needed again following usage wear on the door leaving no easy way to address the gap between the keeper and the spring latch.

What is needed in the art is an electric strike that allows for offloading a preload pressure on the locket caused by a preloaded door condition, reduction of a gap between the keeper and the lockset to minimize excess movement or rattle in the door, ensures that a dead latch of the lockset does not extend to a fully extended position behind the keeper to render the door unsecure, and allows the gap to be easily adjustable based on the condition of the door for the life of the electric strike. The present invention addresses the above-referenced needs as well as other needs.

SUMMARY OF THE INVENTION

Briefly described, one aspect of the present invention is directed to a keeper assembly for an electric strike including a housing defining an entry chamber, wherein the electric strike operates in conjunction with a latch of a lockset. The latch has an engaged position and a released position, wherein the engaged position secures a door within the entry chamber when the door is in a closed state. The keeper assembly comprises a keeper and a keeper shim. The keeper is rotatably mounted to the housing, and is movable between a locked position and an unlocked position. The keeper retains the latch in the entry chamber when the keeper is in the locked position and the latch is in the engaged position. The keeper shim is adjustably mounted to the keeper, wherein a position of the keeper shim relative to the keeper is selected to minimize a gap defined between the keeper shim and the latch.

In another aspect of the invention, the keeper may include a surface wherein the keeper shim is movably disposed on the surface.

In another aspect, the keeper may include an inner surface that faces the entry chamber, wherein the keeper shim is movably disposed on the inner surface. The inner surface may have a recess defined therein, wherein the keeper shim is moveably disposed within the recess. Further, the keeper shim may include at least one aperture defined therein, wherein the keeper assembly further comprises an adjustment mechanism disposed within the at least one aperture that is configured for setting the position of the keeper shim relative to the keeper. The adjustment mechanism may be a set screw, for example. In another aspect, the keeper assembly may include a fastener that couples the keeper shim to the keeper after the position of the keeper shim relative to the keeper is set by the adjustment mechanism. The fastener may be a screw, for example.

In yet another aspect, the keeper may include a keeper base and a ramp element, wherein the ramp element includes a contact surface that is positioned for contacting the latch as the door is moved to the closed position, and wherein the keeper shim includes an upper surface that is disposed on the same plane as the contact surface, or adjacent to the contact surface, to prevent a dead latch of the locket from moving to an enabling position (extended).

In another aspect, an electric strike for use with a latch of a lockset is provided, wherein the latch has an engaged position and a released position, and wherein the engaged position operates to secure a door when in a closed state. The electric strike comprises a housing and a keeper assembly. The housing includes a back wall, and the housing defines an entry chamber for receiving the latch. The keeper assembly includes a keeper and keeper shim. The keeper is rotatably mounted to the housing, and is movable between a locked position and an unlocked position. The keeper retains the latch in the entry chamber when the keeper is in the locked position and the latch is in the engaged position. The keeper shim includes an outer face portion, and is adjustably mounted to the keeper to define a chamber width between the outer face portion and the back wall of the housing. A position of the keeper shim relative to the keeper is selected to minimize a gap defined between the outer face portion of the keeper shim and the latch.

In yet another aspect, a method for adjusting a latch of a lockset relative to a keeper assembly of an electric strike is provided. The electric strike further includes a housing defining an entry chamber. The keeper assembly comprises a keeper and a keeper shim, wherein the keeper is rotatably mounted to the housing and is movable between a locked position and an unlocked position. The keeper retains the latch in the entry chamber when the keeper is in the locked position and the latch is in an engaged position. The keeper shim adjustably mounted to the keeper. The method comprises: a) providing a gap between an outer face portion of the keeper shim and the latch when the latch is in the engaged position and disposed in the entry chamber; and b) adjusting the position of the keeper shim relative to the keeper to reduce the gap between the outer face portion of the keeper shim and the latch when the latch is in the engaged position and disposed in the entry chamber.

In another aspect, the step of adjusting the position of the keeper shim relative to the keeper may include utilizing an adjustment mechanism disposed within at least one aperture defined in the keeper shim to set the position of the keeper shim relative to the keeper. Further, the step of adjusting the position of the keeper shim relative to the keeper may include utilizing a fastener to couple the keeper shim to the keeper after the position of the keeper shim relative to the keeper is set by the adjustment mechanism. Also, the step of adjusting the position of the keeper shim relative to the keeper may include positioning an upper surface of the keeper shim to prevent the dead latch from moving to the enabling position when the keeper is in the locked position and the latch is in the entry chamber. In another aspect, the step of positioning the upper surface of the keeper shim may include disposing the upper surface of the keeper shim in the same plane as, or adjacent to, the contact surface of the ramp element.

Numerous applications, some of which are exemplarily described below, may be implemented using the present invention.

BRIEF DESCRIPTION OF THE DRAWINGS

The present invention will now be described, by way of example, with reference to the accompanying drawings, in which.

Figure 1:
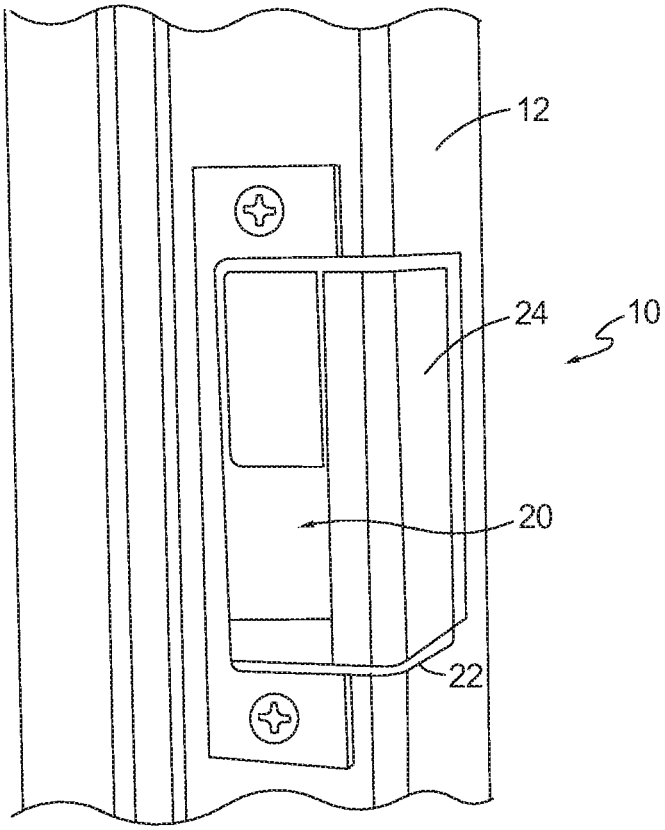
FIG. 1. PRIOR ART
FIG. 1 is a perspective view of a prior art electric strike.
Figure 2:
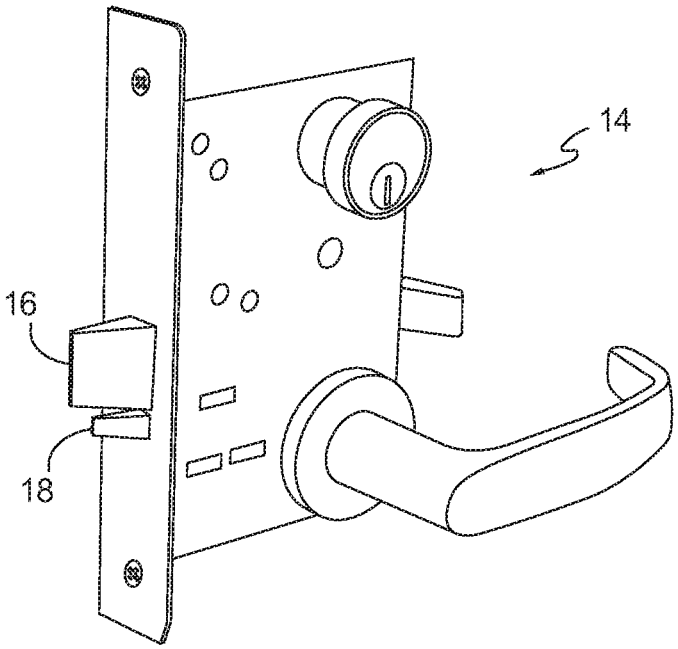
FIG. 2. PRIOR ART
FIG. 2 is a perspective view of a prior art mortise lock set.

Corresponding reference characters indicate corresponding parts throughout the several views. The exemplifications set out herein illustrate currently preferred embodiments of the present invention, and such exemplifications are not to be construed as limiting the scope of the invention in any manner.

DESCRIPTION OF THE PREFERRED EMBODIMENTS

Figure 3:
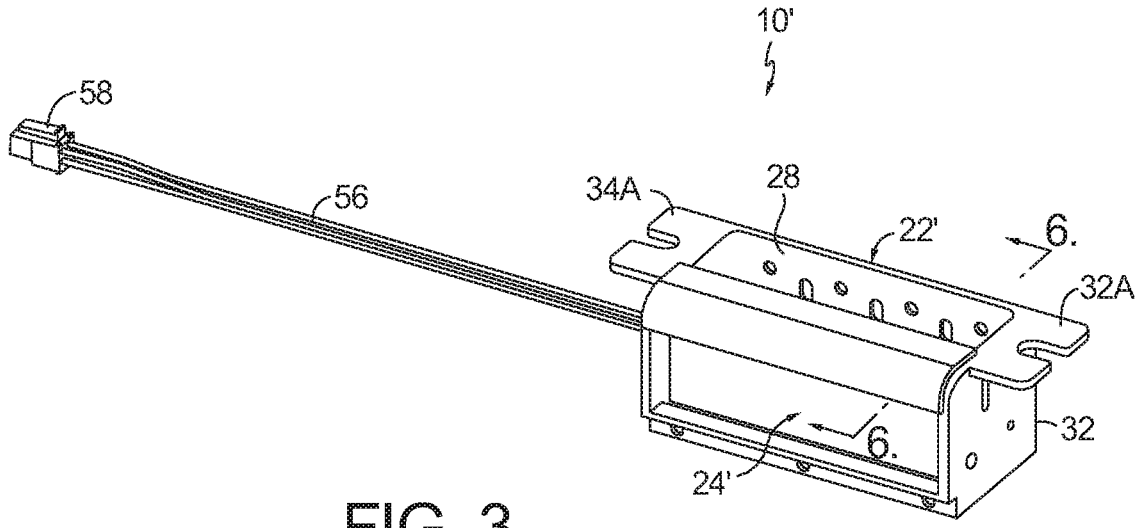
FIG. 3 is a perspective view of an actuator-controlled electric strike that may be used in accordance with the present invention.
Figure 4:
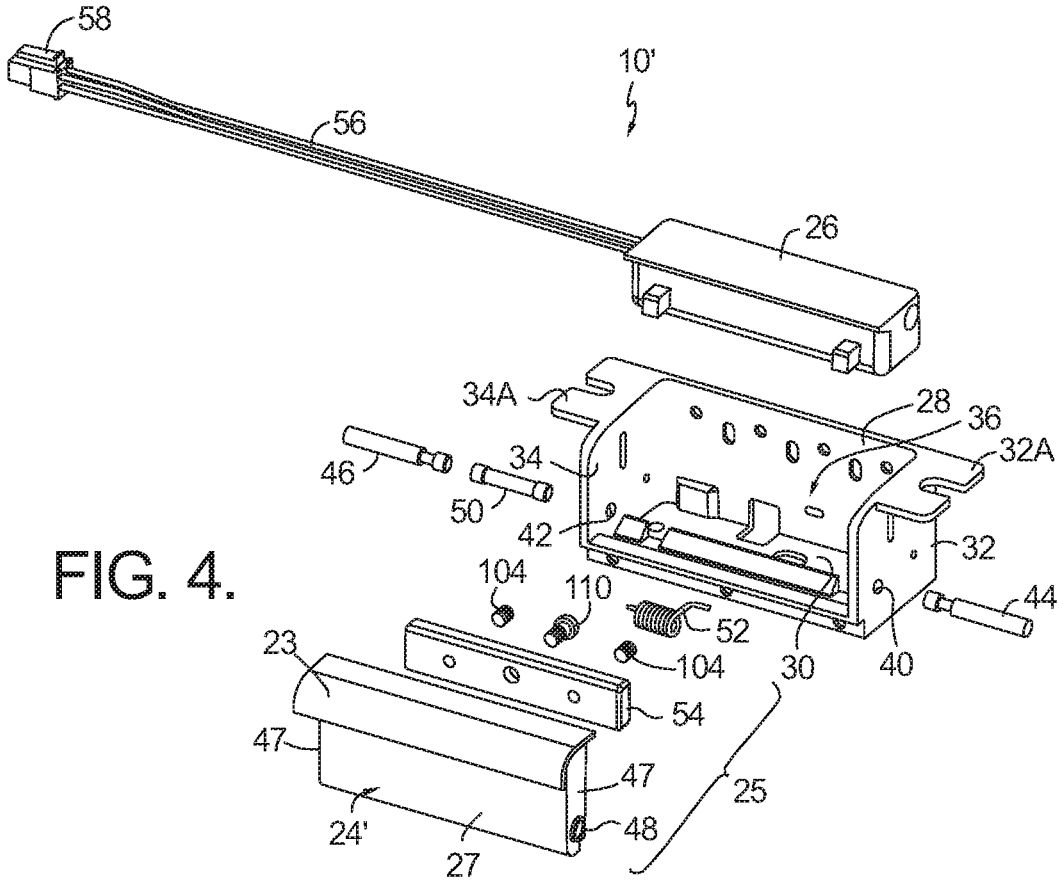
FIG. 4 is an exploded view of the actuator-controlled electric strike shown in FIG. 3.

Referring now to FIGS. 3 and 4, an exemplary electrically-controlled strike that may be used in conjunction with the present invention is generally indicated by reference numeral 10'. Strike 10' generally comprises a housing 22', a keeper assembly 25 rotatably mounted to housing 22', and an actuator module 26. With additional reference to FIG. 7, actuator module 26 may comprise a body 61, an actuator 69 and a keeper release 62, wherein actuator 69 is contained within body 61 and at least a portion of keeper release 62 is contained within body 61. When inserted into housing 22', keeper release 62 is configured to cooperate with keeper assembly 25 to control locking and unlocking of keeper assembly 25 as will be discussed in greater detail below with specific reference to FIGS. 5, 6, 8 and 9.

Figure 5:
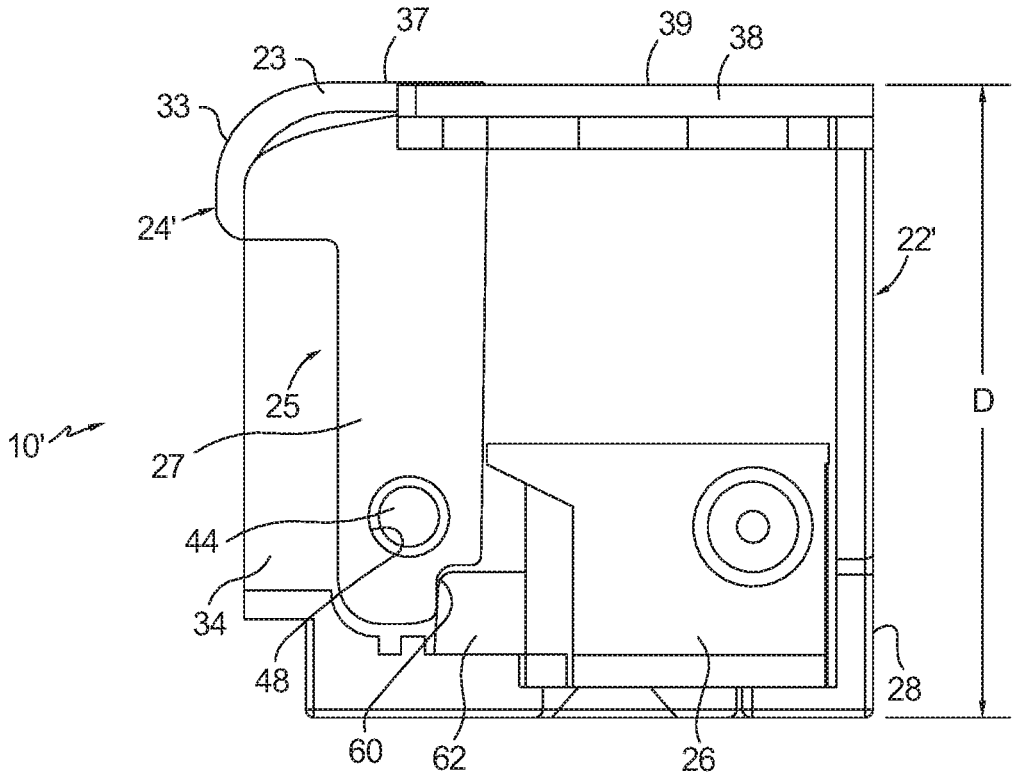
FIG. 5 is a side view of the actuator-controlled electric strike shown in FIG. 3 with the housing shown in phantom view including a strike plate, and the keeper in the locked position.
Figure 6:
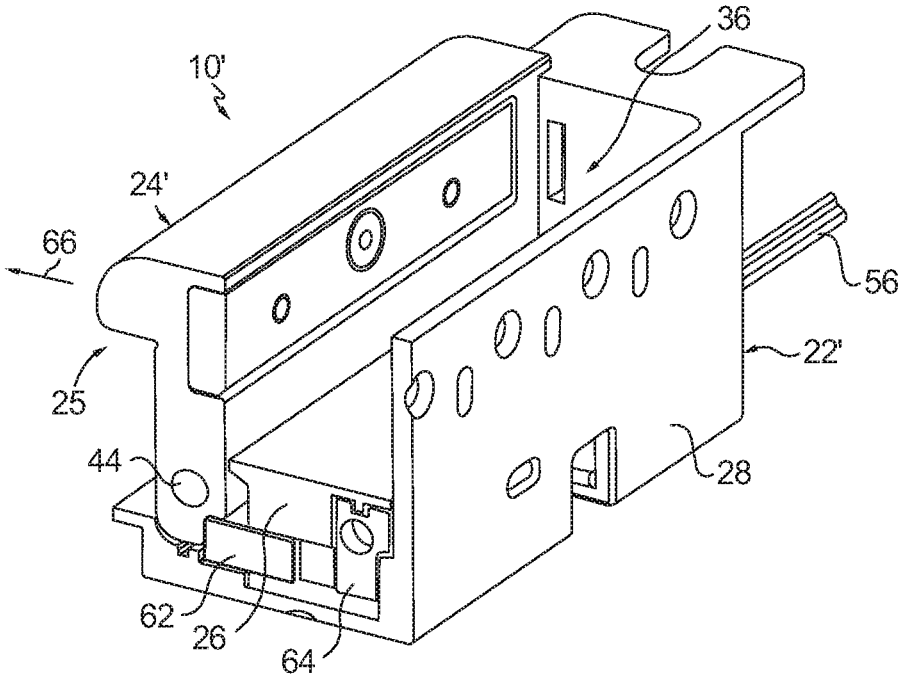
FIG. 6 is a side perspective view of the actuator-controlled electric strike taken along line 6-6 in FIG. 3.

As best seen in FIGS. 3 and 4, housing 22' includes an upstanding back wall 28, bottom panel 30 and opposing upstanding side walls 32, 34 thereby defining an entry chamber 36 having a depth (D) (FIG. 5). Side walls 32, 34 may include flanges 32A, 34A for receiving a strike plate 38, as seen in FIGS. 3, 4 and 5. Side walls 32, 34 may also include apertures 40, 42 configured to receive pivot pin portions 44, 46, respectively. Apertures 40, 42 are positioned so as to coincide with a corresponding through bore 48 passing through a length of keeper assembly 25 such that, upon insertion of pivot pin portions 44, 46, along with a spring pin portion 50, keeper assembly 25 is pivotally mounted onto housing 22'. Spring pin portion 50 is configured to mount a biasing member such as coil spring 52 whereby the coil spring operates to bias keeper assembly 25 toward the closed position, as shown in FIGS. 3, 5 and 6. In accordance with an aspect of the present invention, keeper assembly 25 may further include a keeper shim 54, which will be discussed in more detail below with regard to FIGS. 11-13. Leads 56 are connected at one end to an actuating device resident within actuator module 26 and extend outwardly from housing 22' wherein a second end 58 is connected to a power supply (not shown) so as to power the actuating device on demand.

Figure 7:
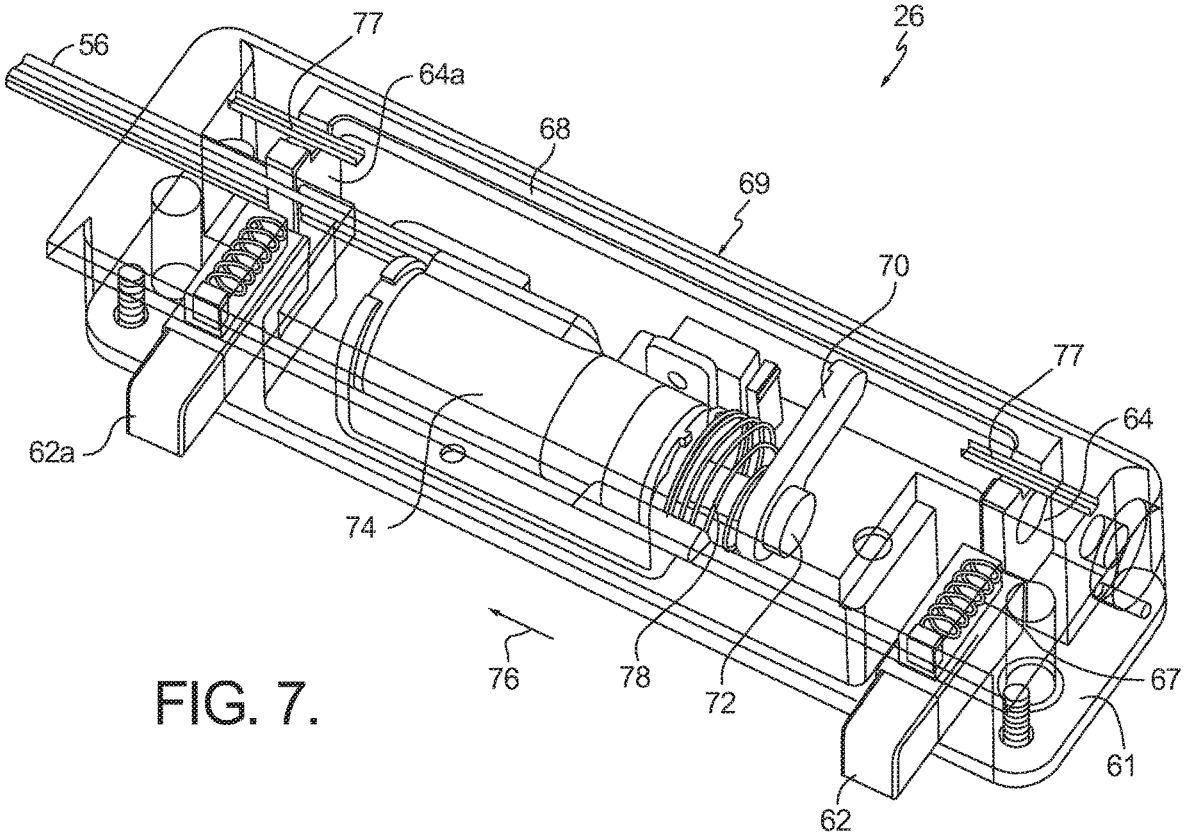
FIG. 7 is a top perspective view of an embodiment of an actuator module that may be used with the actuator-controlled electric strike shown in FIG. 3 wherein the module housing is shown in phantom.
Figure 8:
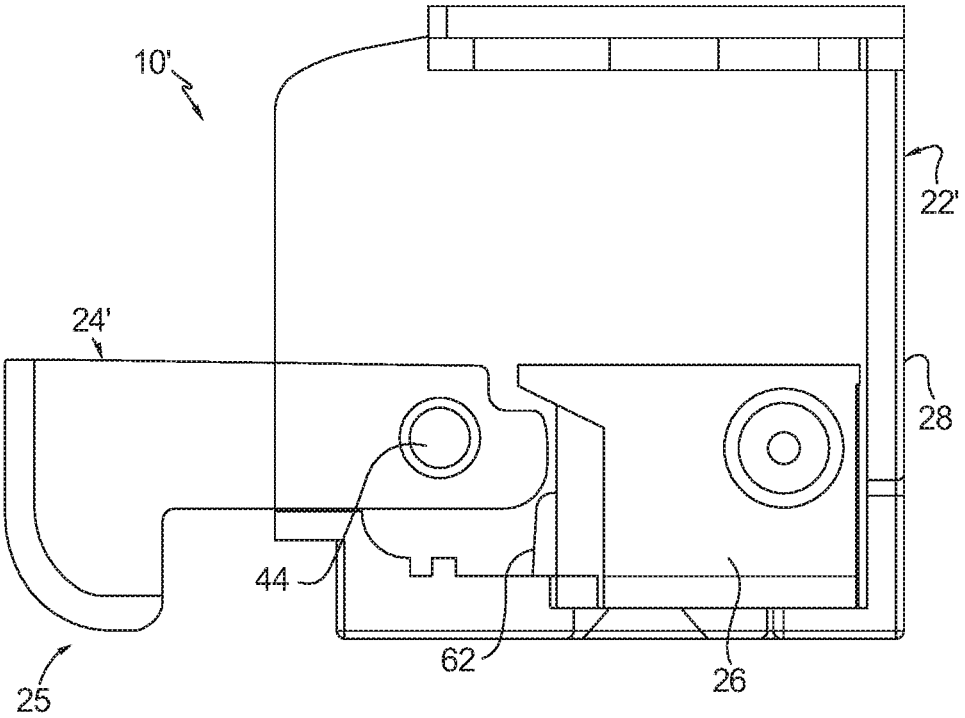
FIG. 8 is a side view of the actuator-controlled electric strike shown in FIG. 3 with the housing shown in phantom view including the strike plate, and the keeper in the unlocked position.
Figure 9:
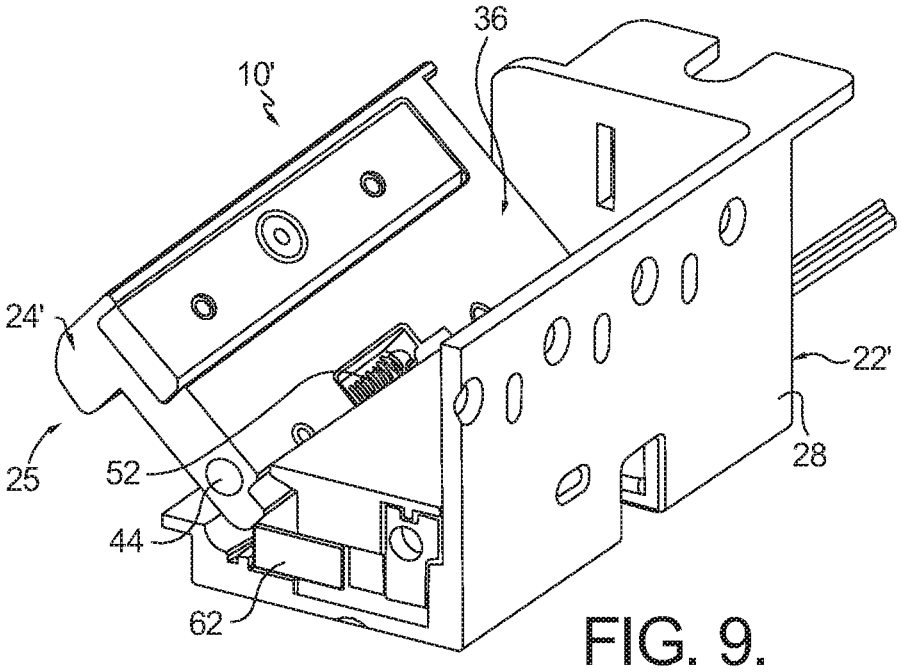
FIG. 9 is a side perspective view of the actuator-controlled electric strike shown in FIG. 8 along the same line as 6-6 in FIG. 1.

FIGS. 5 and 6 show various views of strike 10' with keeper assembly 25 in the closed position, and FIG. 7 shows the internal components of an exemplary actuator module 26 that may reside within housing 22'. Generally, keeper assembly 25 may include a notched portion 60 at the keeper end proximate through bore 48, wherein notched portion 60 is configured to engage keeper release 62 slidably mounted within body 61 of actuator module 26. Keeper release 62, in turn, engages a keeper support 64 of actuator 69 also resident within actuator module 26. In this manner, keeper assembly 25 is in the locked position such that any load placed on keeper assembly 25 (such as an unauthorized attempt to open a door whose latch is secured within entry chamber 36 in the direction generally indicated by arrow 66—FIG. 6) is transferred from keeper assembly 25 through keeper release 62 to keeper support 64 and ultimately to back wall 28 of housing 22'. A biasing member, such as a coil spring 67, operates to bias keeper release 62 into the extended, locked position shown in FIGS. 5 and 6.

Referring now to FIG. 7, actuator module 26 may include keeper release 62 and actuator 69. Actuator 69, in turn, includes an actuating device 74, shown here as a solenoid, and an associated keeper support bracket 68 and keeper support 64. Keeper release 62 engages keeper support 64 which extends downwardly from keeper support bracket 68. Keeper support bracket 68 includes an actuator extension 70 that is configured to mount onto or otherwise engage a plunger 72 of actuating device 74. In the case of a pull type solenoid operating in fail secure mode, actuation of actuating device 74 upon receiving power via leads 56 causes plunger 72 to be pulled into the body of actuating device 74 in the direction generally indicated by arrow 76. As keeper support bracket 68 is engageable with plunger 72 via actuator extension 70, the inward travel of plunger 72 results in a sliding travel of keeper support bracket 68 in direction 76, wherein keeper support bracket 68 may be slidably coupled with a guide 77 that is fixedly positioned relative to body 61. Keeper support 64 is likewise displaced by travel of keeper support bracket 68 such that keeper support 64 is no longer aligned with and operatively coupled to keeper release 62. With additional reference to FIGS. 8 and 9, at this point, any load on keeper assembly 25 (such as an authorized attempt to withdraw a latch from entry chamber 36) operates to pivot keeper assembly 25 about pin portions 44, 46, 50 so that keeper assembly 25 drives keeper release 62 rearwardly, toward back wall 28 of housing 22' against biasing member 67. Once any load on keeper assembly 25 is removed (such as after the removal of the door latch), keeper assembly 25 is returned to its locked position by biasing member 52 while keeper release 62 is returned to the extended position via biasing member 67. In this manner, once power to actuating device 74 has been withdrawn, plunger 72 may return to its original position, such as via a plunger return spring 78, to thereby return keeper support bracket 68 and keeper support 64 to their original positions whereby keeper support 64 is again aligned with and operatively coupled to keeper release 62 so as to lock keeper assembly 25.

As further shown in FIG. 7, actuator module 26 may include second keeper release 62*a* disposed at the opposite end of the module. Second keeper release 62*a* cooperates with second keeper support 64*a* of support bracket 68. The opposing forces imparted on keeper assembly 25 when an unauthorized attempt is made to withdraw the latch from the entry chamber 36 are balanced across the length of keeper assembly 25 and translated evenly through first and second keeper releases 62, 62*a* to the back wall 28 of housing 22'.

Figure 10:
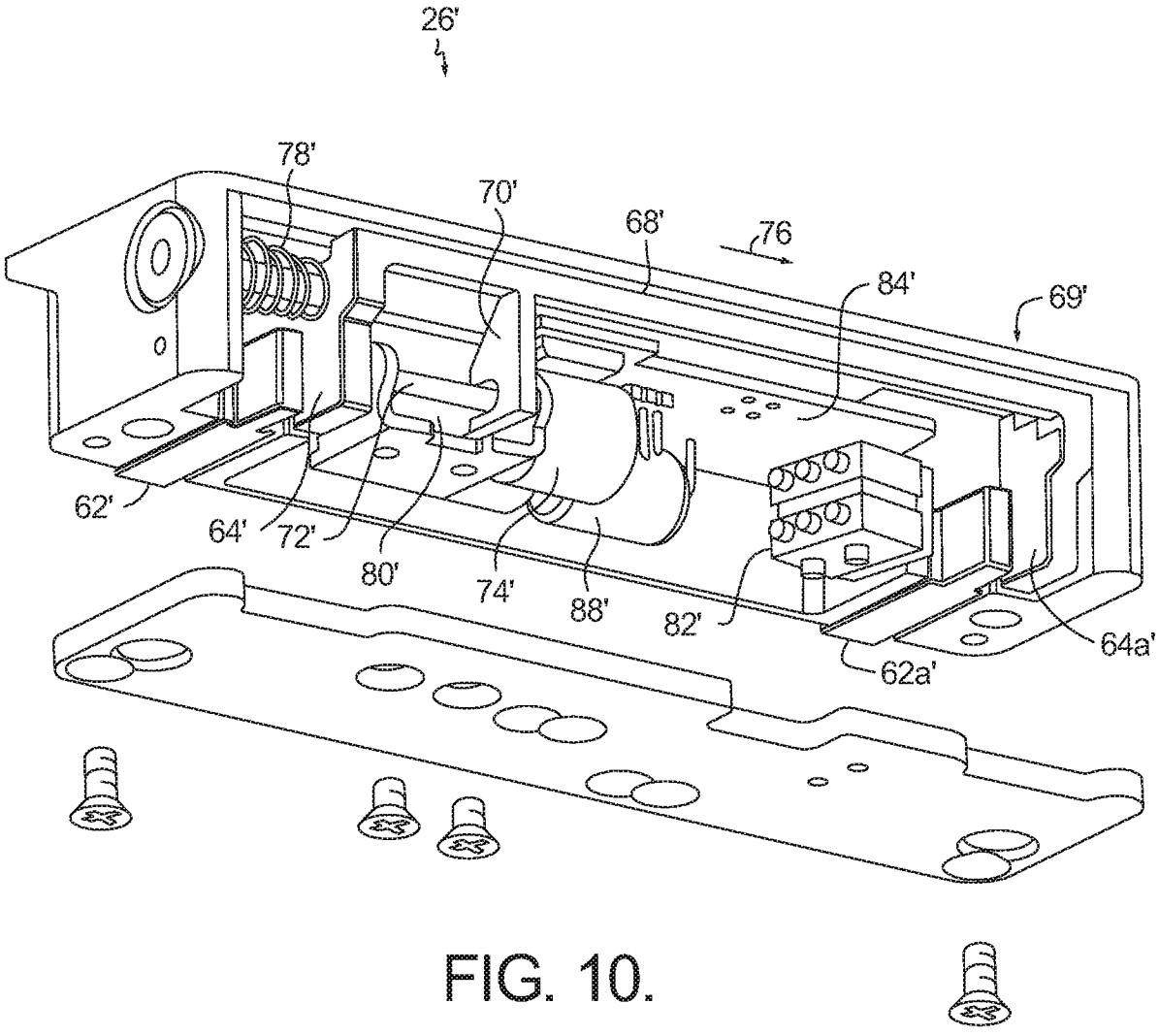
FIG. 10 is a partial exploded bottom perspective view of an embodiment of an actuator module that may be used with the actuator-controlled electric strike shown in FIG. 3.

It should be understood that any suitable actuator can be used in conjunction with strike 10' as described in accordance with the present invention. For example, FIG. 10 shows an alternative actuator module 26' including actuator 69' and keeper release 62'. Actuator 69' includes actuating device 74' such as a stepper motor, and keeper support bracket/support, 68', 64', respectively. As shown, keeper support 64' has been disengaged from keeper release 62' so as to allow pivoting of keeper assembly 25 (not shown) to drive keeper release 62' rearwardly. To facilitate the sliding translation of keeper support 64', keeper support bracket 68' includes an actuator extension 70' configured to engage with rod 72' on stepper motor 74'. Actuation of stepper motor 74' by a voltage having a first polarity causes rotation of shaft 80' so as to advance actuator extension 70' (and keeper support bracket 68' and keeper support 64') in one direction (such as the direction indicated by arrow 76). Supplying a voltage having the opposite polarity then reverses rotation of shaft 80' to advance actuator extension 70' in the opposite direction. A biasing member, such as spring 78', may assist in driving actuator extension 70' in direction 76 toward stepper motor 74'.

As further shown in FIG. 10, actuator module 26' may include second keeper release 62*a'* disposed at the opposite end of the module. Second keeper release 62*a'* cooperates with second keeper support 64*a'* of keeper support bracket 68'. The opposing forces imparted on keeper assembly 25 when an unauthorized attempt is made to withdraw the latch from the entry chamber 36 are balanced across the length on keeper assembly 25 and translated evenly through first and second keeper releases 62',62*a'* to the back wall of housing 22'.

Figure 11:
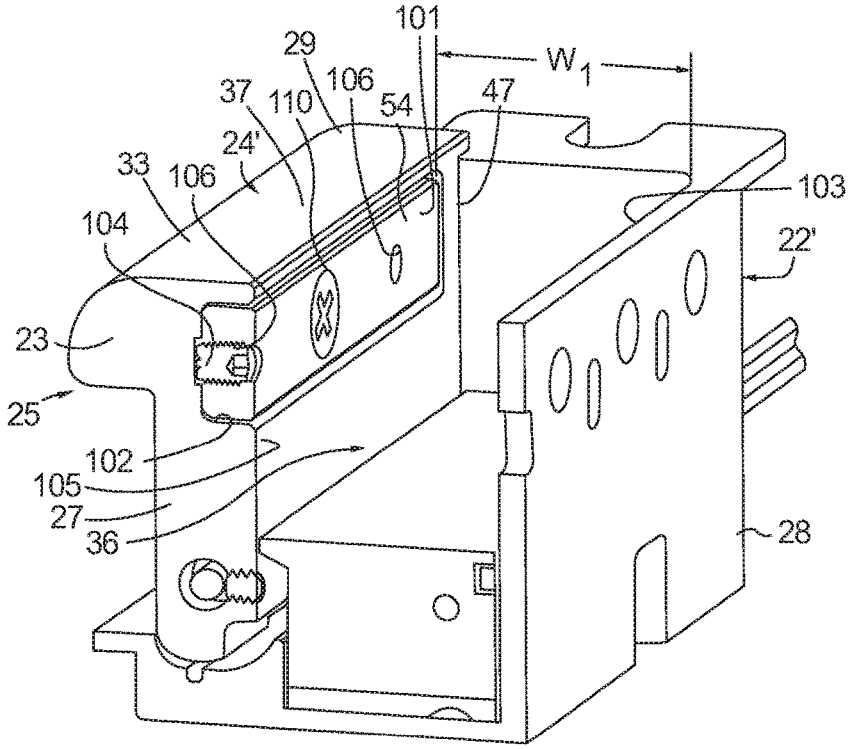
FIG. 11 is a cross sectional perspective view of an actuator-controlled electric strike having a keeper shim in accordance with the present invention with the keeper shim flush with a keeper.

Turning now to FIGS. 4, 11 and 14, in accordance with an aspect of the present invention, keeper assembly 25 may be configured to include a keeper 24' and integrated keeper shim 54. Keeper shim 54 may be adjustably mounted to keeper 24' to selectively define a width of entry chamber 36 as measured between an outer face 101 of keeper shim 54 and an inner surface 103 of back wall 28 of housing 22' (such as from a width ($W_1$) shown in FIG. 11 to width ($W_2$) shown in FIG. 14), thereby allowing for a gap between an extended latch positioned in entry chamber 38 and keeper assembly 25 (e.g., outer face portion 101) to be optimized to offload a preload pressure on the lockset caused by a preloaded door condition and to reduce a gap between the keeper and the lockset to minimize excess movement or rattle in the door. In the case of a cylindrical-type lockset, an optimized gap also ensures that the dead latch of the lockset does not extend to a fully extended position behind keeper assembly 25 to render the door unsecure, and allow the gap to be easily adjustable based on the condition of the door for the life of the strike 10'.

Figure 12:
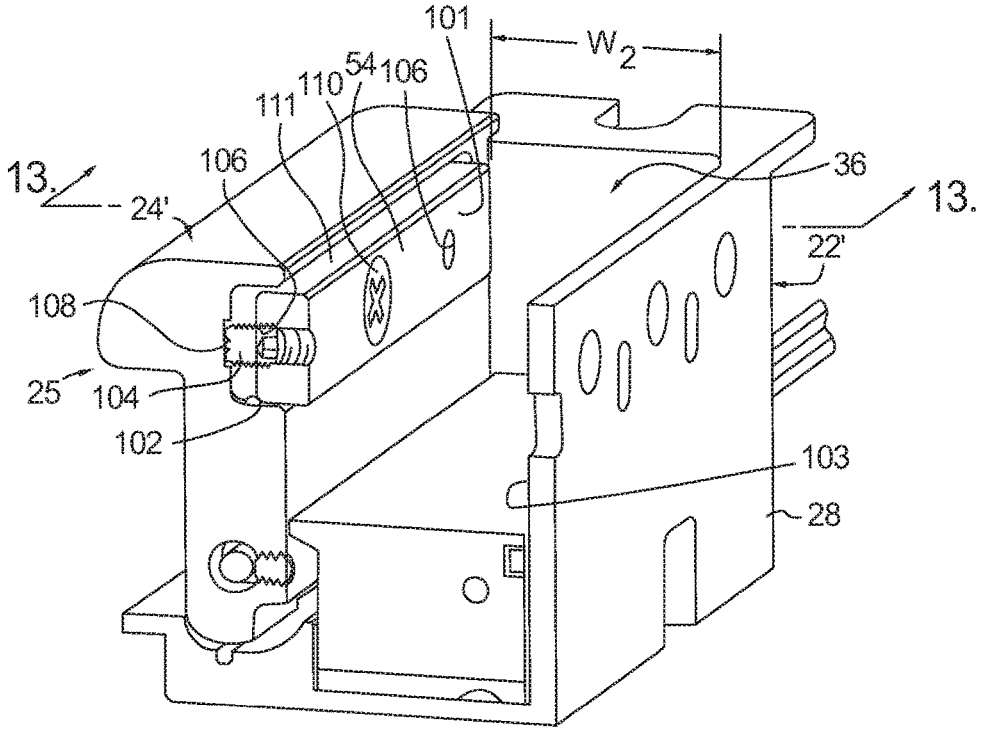
FIG. 12 is a cross sectional perspective view of an actuator-controlled electric strike similar to FIG. 11 having the keeper shim extending from with the keeper into an entry chamber.
Figure 13:
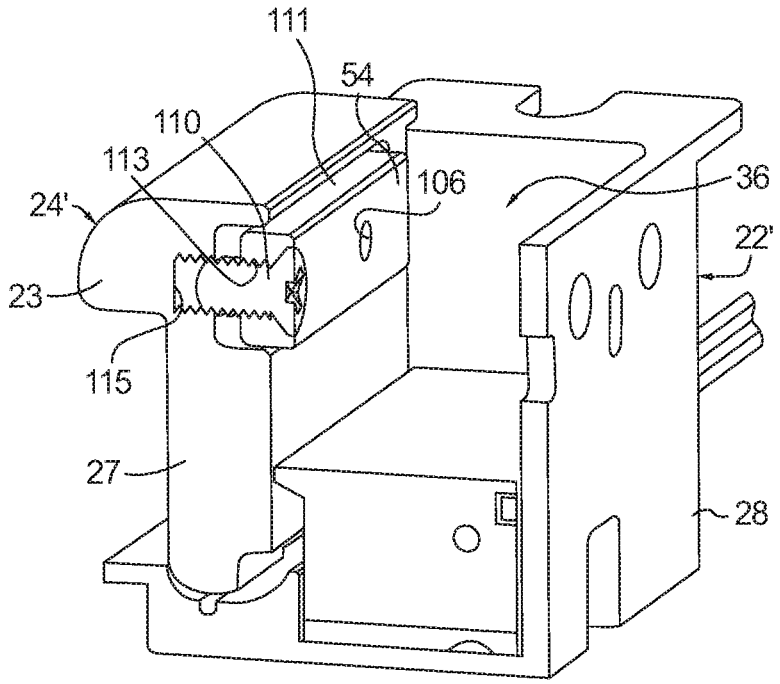
FIG. 13 is a cross sectional perspective view showing the keeper shim connected to the keeper taken along line 13-13 in FIG. 12.

In accordance with this aspect, with additional reference to FIG. 5, keeper 24' may include a ramp element 23 and a keeper base 27, wherein ramp element 23 may include a contact surface 33 that is contactable by the spring latch and/or dead latch of a lockset as the door is moved to a closed position. With reference to FIGS. 11 and 12, keeper base 27 may include an inner surface 105 adapted to receive keeper shim 54. Recess 102 may be defined in inner surface 105 for receiving the keeper shim that faces entry chamber 36 when keeper assembly 25 is in a closed position. Recess 102 may extend longitudinally relative to keeper base 27. One or more adjustment mechanisms, such as set screws 104, for example, may be threadably inserted within corresponding threaded apertures 106, or otherwise moveably secured, within keeper shim 54. Set screws 104 may be selectively advanced to adjust the position of keeper shim 54 relative to keeper base 27 until the desired width is created, i.e., width ($W_2$). Recess 102 may have respective recesses 108 defined therein that are configured to receive and/or contact an end portion of respective set screw 104. Respective recesses 108 may also be used to correctly position keeper shim 54 within recess 102. As best seen in FIG. 13, keeper assembly 25 may also include a fastener, such as hex screw 110, that is threaded or otherwise positioned through a bore 113 formed in keeper shim 54, and further into a corresponding threaded bore 115 formed in keeper base 27 to secure keeper shim 54 to keeper base 27. It will be understood by one skilled in the art that other mechanisms and configurations may be used to set the position of keeper shim 54 relative to keeper 24' and fall within the scope of the present invention. The above-referenced discussion referencing set screws 104 and fastener 110 are merely one example of accomplishing this functionality.

In accordance with this aspect, width ($W_2$) may be selected such there is little movement of the door latch, and subsequently the door, when the latch is positioned within entry chamber 36 of strike 10'. Reduced movement minimizes unnecessary wear and tear on the latch and the strike, as well as reduces door movement and subsequent noise. In addition, when used in conjunction with a cylindrical-type lockset, and when keeper shim 54 is adjusted outward and keeper assembly 25 is in its locked position as shown in FIG. 12, an upper surface 111 of keeper shim 54 may be positioned adjacent to a top portion 37 of contact surface 33 to serve as a resting platform for the dead latch of the lockset when the associated latch is received by entry chamber 36. It should be understood that upper surface 111 may optionally be disposed in the same plane as top portion 37 or below top portion 37 (i.e., adjacent to top portion 37), so long as the dead latch is not permitted to move to the enabling position (extended) that would allow the spring latch to be moved to the released position. Thus, keeper shim 54 provides additional assurance that the dead latch remains retracted when the cylindrical lockset is in a locked position, thereby preventing an unauthorized forced retraction of the associated latch to unlock the door.

Provision of adjustment mechanism 104 enables fine incremental control of the placement of keeper shim 54 over a wide range of entry chamber widths without requiring multiple shim members which are presently employed within the art. Further, in the prior art, a shim pack was provided with the strike product so that, at the time of installation, the width of the entry chamber could be varied as needed, by the selection and installation of the appropriate sized shim to the face of the keeper. However, over time, through usage of the door, the width of the entry chamber can be expected to change, requiring a different sized shim to take up the gapped clearance. Often, the shim pack would be discarded after original strike installation so that a later re-adjustment of the gapped clearance could not be made. In accordance with this aspect of the invention, the ability to re-adjust the gapped clearance remains with the strike so that re-adjustments can be conveniently made at any time after original installation.

In another optional aspect, with reference to FIG. 5, contact surface 33 of keeper assembly 25 may extend a distance (A) beyond a front profile 41 of housing 22' when keeper assembly 25 is in the locked position to prevent the spring latch and/or dead latch from contacting housing 22' or frame 12 as the door is moved to the closed position. For example, contact surface 33 may extend distance (A) beyond a front edge 43 of at least one of side walls 32, 34 when keeper assembly 25 is in the locked position to prevent the spring latch and/or dead latch from contacting housing 22' or frame 12 as the door is moved to the closed position. Further, at least a portion of a profile 45 of contact surface 33 may be configured to match at least a portion of front profile 41 of housing 22', for example, the profile of front edge 43 of at least one of side walls 32, 34. While profile 45 of contact surface 33 is shown as being rounded, it should be understood that other profiles are also contemplated herein.

In accordance with a further aspect of the present invention, a method for adjusting a latch of a lockset relative to a keeper assembly of an electric strike is provided. As mentioned above, the keeper assembly may comprise a keeper and a keeper shim, wherein the keeper is rotatably mounted to the housing and is movable between a locked position and an unlocked position. The keeper retains the latch in the entry chamber when the keeper is in the locked position and the latch is in an engaged position. In accordance with an aspect of the present invention, the keeper shim is adjustably mounted to the keeper. The method comprises the steps of: a) providing a gap between an outer face portion of the keeper shim and the latch when the latch is in the engaged position and disposed in the entry chamber; and b) adjusting the position of the keeper shim relative to the keeper to reduce the gap between the outer face portion of the keeper shim and the latch when the latch is in the engaged position and disposed in the entry chamber.

In a further aspect of the method, the keeper shim may further include at least one aperture defined therein, wherein the step of adjusting the position of the keeper shim relative to the keeper may include utilizing an adjustment mechanism disposed within the at least one aperture to set the position of the keeper shim relative to the keeper. The step of adjusting the position of the keeper shim relative to the keeper may further include utilizing a fastener to couple the keeper shim to the keeper after the position of the keeper shim relative to the keeper is set by the adjustment mechanism. Further, the step of adjusting the position of the keeper shim relative to the keeper further may include positioning the upper surface of the keeper shim to prevent the dead latch from moving to the enabling position when the keeper is in the locked position and the latch is in the entry chamber.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A keeper assembly for an electric strike including a housing defining an entry chamber, wherein the electric strike operates in conjunction with a latch of a lockset for a door, wherein the latch has an engaged position and a released position, wherein the engaged position secures the latch within the entry chamber when the door is in a closed state, the keeper assembly comprising:

a) a keeper rotatably mounted to the housing, wherein said keeper includes a keeper base, wherein said keeper is movable between a locked position and an unlocked position, and wherein said keeper retains the latch in the entry chamber when the keeper is in the locked position and the latch is in the engaged position;

b) a keeper shim mounted to said keeper base of said keeper, wherein said keeper shim includes an outer face contactable by the latch when the latch is in the engaged position;

c) an adjustment mechanism associated with said keeper shim, wherein the adjustment mechanism is configured to selectively adjust the position of said outer face of said keeper shim relative to said keeper base, and wherein said selective adjustment of the position of said outer face of said keeper shim is made to minimize a gap defined between said outer face of said keeper shim and the latch when the latch is in the engaged position and said keeper is in the locked position; and d) a fastener that couples said keeper shim to said keeper after the position of said keeper shim relative to said keeper is set by said adjustment mechanism.

2. The keeper assembly in accordance with claim 1 wherein said keeper base includes a surface, wherein said keeper shim is moveably disposed on said surface.

3. The keeper assembly in accordance with claim 2 wherein said surface has a recess defined therein, and wherein said keeper shim is moveably disposed within said recess.

4. The keeper assembly in accordance with claim 2 wherein said surface is an inner surface facing said entry chamber.

5. The keeper assembly in accordance with claim 1 wherein said keeper shim includes at least one aperture defined therein and said adjustment mechanism is disposed within said at least one aperture.

6. The keeper assembly in accordance with claim 1 wherein said adjustment mechanism is a screw.

7. The keeper assembly in accordance with claim 1 wherein said fastener is a screw.

8. The keeper assembly in accordance with claim 1 wherein the keeper includes a ramp element, wherein said ramp element includes a contact surface that is positioned for contacting the latch as the door is moved to the closed position, and wherein said keeper shim includes an upper surface that is disposed on the same plane as said contact surface.

9. An electric strike for use with a latch of a lockset, wherein the latch has an engaged position and a released position, wherein the engaged position operates to secure a door when in a closed state, the electric strike comprising:

a) a housing including a back wall, wherein said housing defines an entry chamber for receiving the latch; and b) a keeper assembly including:

i) a keeper rotatably mounted to said housing, wherein said keeper includes a keeper base, wherein said keeper is movable between a locked position and an unlocked position, and wherein said keeper retains the latch in said entry chamber when said keeper is in said locked position and the latch is in the engaged position;

ii) a keeper shim including an outer face contactable by the latch when the latch is in the engaged position, wherein the keeper shim is mounted to said keeper base of said keeper to define a chamber width between said outer face and said back wall of said housing;

iii) an adjustment mechanism associated with said keeper shim, wherein said adjustment mechanism is configured to selectively adjust the position of said outer face of said keeper shim relative to said keeper base, and wherein said selective adjustment of the position of said outer face of said keeper shim is made to minimize a gap defined between said outer face of said keeper shim and the latch when the latch is in the engaged position and said keeper is in said locked position; and iv) a fastener that couples said keeper shim to said keeper after the position of said keeper shim relative to said keeper is set by the adjustment mechanism.

10. The electric strike in accordance with claim 9 wherein said keeper includes an inner surface that faces said entry chamber, and wherein said keeper shim is moveably disposed on said inner surface.

11. The electric strike in accordance with claim 10 wherein said inner surface has a recess defined therein, and wherein said keeper shim is moveably disposed within said recess.

12. The electric strike in accordance with claim 9 wherein said keeper shim includes at least one aperture defined therein, and wherein said adjustment mechanism is disposed within said at least one aperture and configured for setting the position of said keeper shim relative to said keeper.

13. The electric strike in accordance with claim 12 wherein said adjustment mechanism is a screw.

14. The electric strike in accordance with claim 9 wherein said fastener is a screw.

15. The electric strike in accordance with claim 9 wherein said keeper includes a ramp element, wherein said ramp element includes a contact surface that is positioned for contacting the latch as the door is moved to the closed position, wherein said keeper shim includes an upper surface that is disposed on the same plane as said contact surface.

16. A method for selectively adjusting a lockset of an electric strike, wherein the electric strike includes a housing defining an entry chamber, wherein the electric strike comprises a housing, a keeper having a keeper base, and a keeper shim, wherein the keeper is rotatably mounted to the housing and movable between a locked position and an unlocked position, wherein the keeper retains the latch in the entry chamber when the keeper is in the locked position and the latch is in an engaged position, and wherein the keeper shim is adjustably mounted to the keeper base, the method comprising:

a) providing an adjustment mechanism associated with the keeper shim;

b) providing a gap between an outer face of the keeper shim and the latch when the latch is in the engaged position and the keeper is in said locked position;

c) adjusting the position of the outer face of the keeper shim relative to the keeper base with the adjustment mechanism to minimize the gap between the outer face of the keeper shim and the latch when the latch is in the engaged position and the keeper is in the locked position; and d) utilizing a fastener to couple the keeper shim to the keeper base after the position of the keeper shim relative to the keeper base is set by the adjustment mechanism.

17. The method in accordance with claim 16 wherein the keeper shim includes at least one aperture defined therein, and wherein the step of adjusting the position of the outer face of the keeper shim relative to the keeper base includes utilizing the adjustment mechanism disposed within the at least one aperture to set the position of the outer face of the keeper shim relative to the keeper base.

18. The method in accordance with claim 16 wherein the lockset includes a dead latch configured for moving between an enabling position and a disabling position, wherein the keeper shim includes an upper surface, wherein the step of adjusting the position of the outer face of the keeper shim relative to the keeper base further includes positioning the upper surface of the keeper shim to prevent the dead latch from moving to the enabling position when the keeper is in the locked position and the latch is in the entry chamber.

19. The method in accordance with claim 18 wherein the keeper includes a ramp element, wherein the ramp element includes a contact surface that is positioned for contacting the latch as the door is moved to the closed position, wherein the step of positioning the upper surface of the keeper shim includes disposing the upper surface of the keeper shim in the same plane as the contact surface of the ramp element.

20. A keeper assembly for an electric strike including a housing defining an entry chamber, wherein the electric strike operates in conjunction with a latch of a lockset for a door, wherein the latch has an engaged position and a released position, wherein the engaged position secures the latch within the entry chamber when the door is in a closed state, the keeper assembly comprising:

a) a keeper rotatably mounted to the housing, wherein said keeper includes a keeper base, wherein said keeper is movable between a locked position and an unlocked position, and wherein said keeper retains the latch in the entry chamber when the keeper is in the locked position and the latch is in the engaged position;

b) a keeper shim having a threaded aperture formed therein, and wherein the keeper shim is mounted to said keeper base of said keeper, wherein said keeper shim includes an outer face contactable by the latch when the latch is in the engaged position; and c) a threaded screw engaged with said threaded aperture of said keeper shim, wherein the threaded screw is configured to selectively adjust the position of said outer face of said keeper shim relative to said keeper base, and wherein when said selective adjustment of the position of said outer face of said keeper shim is made, said keeper shim is fixedly secured to the keeper base to minimize a gap defined between said outer face of said keeper shim and the latch when the latch is in the engaged position and said keeper is in the locked position.

21. The keeper assembly in accordance with claim 20 wherein said keeper base includes a surface, wherein said keeper shim is moveably disposed on said surface.

22. The keeper assembly in accordance with claim 21 wherein said surface has a recess defined therein, and wherein said keeper shim is moveably disposed within said recess.

23. The keeper assembly in accordance with claim 21 wherein said surface is an inner surface facing said entry chamber.

24. The keeper assembly in accordance with claim 20 wherein the keeper includes a ramp element, wherein said ramp element includes a contact surface that is positioned for contacting the latch as the door is moved to the closed position, and wherein said keeper shim includes an upper surface that is disposed on the same plane as said contact surface.

* * * * *